United States Patent [19]

Roling et al.

[11] Patent Number: 4,749,468

[45] Date of Patent: Jun. 7, 1988

[54] METHODS FOR DEACTIVATING COPPER IN HYDROCARBON FLUIDS

[75] Inventors: Paul V. Roling, Spring; Joseph H. Y. Niu; Dwight K. Reid, both of Houston, all of Tex.

[73] Assignee: Betz Laboratories, Inc., Trevose, Pa.

[21] Appl. No.: 904,598

[22] Filed: Sep. 5, 1986

[51] Int. Cl.[4] ..... C10G 21/00

[52] U.S. Cl. ..... 208/48 AA; 208/48 R; 208/251 R; 208/255; 252/51; 423/DIG. 14; 585/950

[58] Field of Search ..... 252/51 R; 208/251 R, 208/255, 48 R, 48 AA; 423/DIG. 14; 585/950

[56] References Cited

U.S. PATENT DOCUMENTS

| | | | |
|---|---|---|---|
| Re. 26,330 | 5/1968 | Colfer | 208/48 |
| 2,347,626 | 4/1944 | Bradley | 208/22 |
| 2,353,192 | 7/1944 | Sargent et al. | 252/51.5 R |
| 2,962,442 | 11/1960 | Andress | 252/51.5 |
| 3,023,161 | 2/1962 | Luvisi et al. | 208/251 R |
| 3,034,876 | 5/1962 | Gee et al. | 44/62 |
| 3,050,461 | 8/1962 | Luvisi et al. | 208/251 R |
| 3,068,083 | 12/1962 | Gee et al. | 44/70 |
| 3,132,085 | 5/1964 | Summers | 208/48 |
| 3,200,106 | 8/1965 | Dickson et al. | 208/251 R |
| 3,214,376 | 10/1965 | Morway | 252/51.5 R |
| 3,225,099 | 12/1965 | Coffield | 252/51.5 R |
| 3,235,484 | 2/1966 | Colfer | 208/48 |
| 3,355,270 | 11/1967 | Amick et al. | 44/68 |
| 3,368,972 | 2/1968 | Otto | 252/51.5 R |
| 3,413,347 | 11/1968 | Worrel | 252/51.5 R |
| 3,437,583 | 4/1969 | Gonzales | 208/48 |
| 3,442,791 | 5/1969 | Gonzales | 208/48 |
| 3,756,943 | 9/1973 | Hopkins et al. | 308/48 AA |
| 3,787,458 | 1/1974 | Piasek et al. | 252/51.5 R |
| 3,980,567 | 9/1976 | Pindar et al. | 252/51.5 R |
| 3,985,802 | 10/1976 | Piasek et al. | 252/51.5 R |
| 4,032,304 | 6/1977 | Dorer et al. | 44/58 |
| 4,157,308 | 6/1979 | Wilgus et al. | 252/51.5 R |
| 4,157,309 | 6/1979 | Wilgus et al. | 252/51.5 R |
| 4,166,726 | 9/1979 | Harle | 44/73 |
| 4,170,562 | 10/1979 | West | 252/51.5 R |
| 4,200,545 | 4/1980 | Clason et al. | 44/58 |
| 4,242,212 | 12/1980 | Hanson | 252/251.5 R |
| 4,396,517 | 8/1983 | Gemmil, Jr. et al. | 252/51.5 R |
| 4,539,099 | 9/1985 | Merchant et al. | 208/251 R |
| 4,548,725 | 10/1985 | Bridger | 208/18 |
| 4,666,683 | 5/1987 | Brown et al. | 423/DIG. 14 |

OTHER PUBLICATIONS

C. J. Pedersen (Ind. Eng. Chem., 41, 924–928, 1949).

*Primary Examiner*—Helen M. S. Sneed
*Assistant Examiner*—Helane Myers
*Attorney, Agent, or Firm*—Alexander D. Ricci; Bruce E. Peacock

[57] ABSTRACT

Certain Mannich reaction products (i.e., alkylated phenol, polyamine, and an aldehyde) are used to deactivate first row transition metal species contained in hydrocarbon fluids. Left untreated, such metals lead to decomposition resulting in the formation of gummy, polymer masses in the hydrocarbon liquid.

20 Claims, No Drawings

METHODS FOR DEACTIVATING COPPER IN HYDROCARBON FLUIDS

BACKGROUND OF THE INVENTION

This invention relates to the use of chelating molecules to deactivate copper species to prevent fouling in hydrocarbon fluids.

In a hydrocarbon stream, saturated and unsaturated organic molecules, oxygen, peroxides, and metal compounds are found, albeit the latter three in trace quantities. Of these materials, peroxides can be the most unstable, decomposing at temperatures from below room temperature and above depending on the molecular structure of the peroxide (G. Scott, "Atmospheric Oxidation and Antioxidants", published by Elsevier Publishing Co., NY, 1965).

Decomposition of peroxides will lead to free radicals, which then can start a chain reaction resulting in polymerization of unsaturated organic molecules. Antioxidants can terminate free radicals that are already formed.

Metal compounds and, in particular, transition metal compounds such as copper can initiate free radical formation in three ways. First, they can lower the energy of activation required to decompose peroxides, thus leading to a more favorable path for free radical formation. Second, metal species can complex oxygen and catalyze the formation of peroxides. Last, metal compounds can react directly with organic molecules to yield free radicals.

The first row transition metal species manganese, iron, cobalt, nickel, and copper are found in trace quantities (0.01 to 100 ppm) in crude oils, in hydrocarbon streams that are being refined, and in refined products. C. J. Pedersen (Inc. Eng. Chem., 41, 924–928, 1949) showed that these transition metal species reduce the induction time for gasoline, an indication of free radical initiation. Copper compounds are more likely to initiate free radicals than the other first row transition elements under these conditions.

To counteract the free radical initiating tendencies of the transition metal species and, in particular, copper, so called metal deactivators are added to fluids. These materials are organic chelators that tie up the orbitals on the metal rendering the metal inactive. When metal species are deactivated, fewer free radicals are initiated and smaller amounts of antioxidants would be needed to inhibit polymerization.

Not all chelators will function as metal deactivators. In fact, some chelators will act as metal activators. Pedersen showed that while copper is deactivated by many chelators, other transition metals are only deactivated by selected chelators.

PRIOR ART

Schiff Bases such as N,N'-salicylidene-1,2-diaminopropane are the most commonly used metal deactivators. In U.S. Pat. Nos. 3,034,876 and 3,068,083, the use of this Schiff Base with esters were claimed as synergistic blends for the thermal stabilization of jet fuels.

Gonzales, in U.S. Pat. No. 3,437,583 and 3,442,791, claimed the use of N,N'-disalicylidene-1,2-diaminopropane in combination with the product from the reaction of a phenol, an amine, and an aldehyde as a synergistic antifoulant. Alone the product of reaction of the phenol, amine, and aldehyde had little, if any, antifoulant activity.

Products from the reaction of a phenol, an amine, and an aldehyde (known as Mannich-type products) have been prepared in many ways with differing results due to the method of preparation and due to the exact ratio of reactants and the structure of the reactants.

Metal chelators were prepared by a Mannich reaction in U.S. Pat. No. 3,355,270. Such chelators were reacted with copper to form a metal chelate complex which was used as a catalyst for furnace oil combustion. The activity of the copper was not decreased or deactivated by the Mannich reaction chelator.

Mannich-type products were used as dispersants in U.S. Pat. Nos. 3,235,484 and Re. 26,330 and 4,032,304 and 4,200,545. A Mannich-type product in combination with a polyalkylene amine was used to provide stability in preventing thermal degradation of fuels in U.S. Pat. No. 4,166,726.

Copper, but not iron, is effectively deactivated by metal chelators such as N,N'-disalicylidene-1,2-diaminopropane. Mannich-type products, while acting as chelators for the preparation of catalysts or as dispersants, have not been shown to be copper ion deactivators.

DESCRIPTION OF THE INVENTION

Accordingly, it is an object of the inventors to provide an effective copper deactivator for use in hydrocarbon mediums so as to inhibit free radical formation during the high temperature (e.g., 100°–1000° F., commonly 600°–1000° F.) processing of the hydrocarbon fluid. It is an even more specific object to provide an effective copper deactivator that is capable of performing efficiently even when used at low dosages.

We have found that copper is effectively deactivated by the use of certain Mannich-type products formed via reaction of the reactants (A), (B), and (C); wherein (A) is an alkyl substituted phenol of the structure

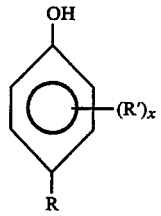

FORMULA (I)

wherein R and $R^1$ are the same or different and are independently selected from alkyl, aryl, alkaryl, or arylalkyl of from about 1 to 20 carbon atoms, x is 0 or 1; wherein (B) is a polyamine of the structure $$H_2N(\underset{\underset{R_2}{|}}{CH}-(CH_2)_y-\underset{\underset{R_3}{|}}{CH}-NH)_Z-H \qquad \text{FORMULA (II)}$$

wherein Z is a positive integer, $R_2$ and $R_3$ may be the same or different and are independently selected from H, alkyl, aryl, aralkyl, or alkaryl having from 1 to 20 carbon atoms, y may be 0 or 1; and wherein (C) is an aldehyde of the structure

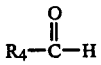

FORMULA (III)

wherein R4 is selected from hydrogen and alkyl having from 1 to 6 carbon atoms.

As to exemplary compounds falling within the scope of Formula I supra, p-cresol, 4-ethylphenol, 4-t-butylphenol, 4-t-amylphenol, 4-t-octylphenol, 4-dodecylphenol, 2,4-di-t-butylphenol, 2,4-di-t-amylphenol, and 4-nonylphenol may be mentioned. At present, it is preferred to use 4-nonylphenol as the Formula I component.

Exemplary polyamines which can be used in accordance with Formula II include ethylenediamine, propylene diamine, diethylene triamine, triethylene tetramine, tetraethylene pentamine and the like, with ethylenediamine being preferred.

The aldehyde component can comprise, for example, formaldehyde, acetaldehyde, propanaldehyde, butrylaldehyde, hexaldehyde, heptaldehyde, etc. with the most preferred being formaldehyde which may be used in its monomeric form, or, more conveniently, in its polymeric form (i.e., paraformaldehyde).

As is conventional in the art, the condensation reaction may proceed at temperatures from about 50° to 200° C. with a preferred temperature range being about 75°-175° C. As is stated in U.S. Pat. No. 4,166,726, the time required for completion of the reaction usually varies from about 1-8 hours, varying of course with the specific reactants chosen and the reaction temperature.

As to the molar range of components (A):(B):(C) which may be used, this may fall within 0.5-5:1:0.5-5.

The copper deactivators of the invention may be dispersed within the hydrocarbon medium within the range of 0.05 to 50,000 ppm based upon one million parts of the hydrocarbon medium. Preferably, the copper deactivator is added in an amount from about 1 to 10,000 ppm.

In an even more specific aspect of the invention and one that is of particular commercial appeal, specific Mannich products are used to effectively deactivate both copper and iron. This aspect is especially attractive since iron is often encountered in hydrocarbons as a metal species capable of promoting polymerization of organic impurities. The capacity to deactivate both copper and iron is unique and quite unpredictable. For instance, the commonly used metal deactivator, N,N'-disalicylidene-1,2-diaminopropane, deactivates copper, but actually activates iron under the ASTM D-525 test.

In this narrower embodiment of the invention, it is critical that ethylenediamine be used as the polyamine (B) Mannich component. Also, with respect to concurrent copper and iron deactivation, the molar ratio of components (A):(B)-ethylenediamine:(C) should be within the range of 1-2:1:1-2 with the (A):(B):(C) molar range of 2:1:2 being especially preferred.

EXAMPLES

The invention will now be further described with reference to a number of specific examples which are to be regarded solely as illustrative and not as restricting the scope of the invention. Comparative examples are designated with letters while examples that exemplify this invention are given numbers.

Testing Methods

Four test methods were employed to determine the deactivating ability of chelators. These were: (1) hot wire test, (2) peroxide test, (3) oxygen absorption test, and (4) ASTM D-525-80.

Hot Wire Test

I. Objective: To screen preparations according to the amount of fouling protection they exhibit.

II. Method Outline: Samples treated with candidate materials are placed in hot wire apparatus and electrically heated. Fouling deposits from an untreated sample are compared with those of the treatments.

Peroxide Test

The peroxide test involves the reaction of a metal compound, hydrogen peroxide, a base, and a metal chelator. In the presence of a base, the metal species will react with the hydrogen peroxide yielding oxygen. When a metal chelator is added, the metal can be tied up resulting in the inhibition of the peroxide decomposition or the metal can be activated resulting in the acceleration of the rate of decomposition. The less oxygen generated in a given amount of time, the better the metal deactivator.

A typical test is carried out as follows: In a 250-mL two-necked, round-bottomed flask equipped with an equilibrating dropping funnel, a gas outlet tube, and a magnetic stirrer, was placed 10 mL of 3% (0.001 mol) hydrogen peroxide in water, 10 mL of a 0.01M (0.0001 mol) metal naphthenate in xylene solution, and metal deactivator. To the gas outlet tube was attached a water-filled trap. The stirrer was started and stirring kept at a constant rate to give good mixing of the water and organic phases. Ammonium hydroxide (25 mL of a 6% aqueous solution) was placed in the dropping funnel, the system was closed, and the ammonium hydroxide added to the flask. As oxygen was evolved, water was displaced, with the amount being recorded as a factor of time. A maximum oxygen evolution was 105 mL. With metal species absent, oxygen was not evolved over 10 minutes.

Oxygen Absorption Test

In the oxygen absorption test, a metal compound, N,N-diethylhydroxylamine (DEHA), a basic amine, and a metal chelator are placed in an autoclave and 50 to 100 psig of oxygen over-pressure is charged to the autoclave. The change in pressure versus time is recorded. With only the metal compound, DEHA, and a basic amine present, absorption of oxygen occurs. A metal deactivator in the reaction will chelate the metal in such a way to inhibit the oxygen absorption. The less the pressure drop, the better the metal deactivator.

A typical test used 1.25 g of a 6% metal naphthenate solution, 5.6 g of DEHA, 5.6 g of N-(2 aminoethyl)piperazine, 12.5 g of heavy aromatic naphtha as solvent, and about 2 g of metal chelator. Pressure drops of from 0 to 48 psig were found over a 60 minute time period. With metal species absent, oxygen was not absorbed.

ASTM D-525-80

In the ASTM test, a sample of a feedstock known to polymerize is placed in an autoclave with a metal compound, an antioxidant, and a metal chelator. An overpressure of 100 psig of oxygen is added and the apparatus is heated on a hot water bath to 100° C. until a drop in pressure is noted signifying the loss of antioxidant activity. The longer the time until a drop in pressure occurs, the more effective the antioxidant and/or metal deactivator.

EXAMPLES

Hot wire tests using 80 ppm of copper naphthenate as the corrosive species were undertaken with respect to several Mannich products of the invention and a commercially known metal deactivator. Results appear in Table I.

TABLE I

| Deactivator | Molar Ratio A:B:C | Concentration Used (ppm) | Coke (mg) |
|---|---|---|---|
| 1. Blank | — | — | 7.5 |
| 2. p-t-butyl phenol-ethylenediamine (EDA)-paraformaldehyde (PF) | 2:1:2 | 350 | 0 |
| 3. p-nonylphenol-EDA-PF | 4:1:4 | 220 | 3.1 |
| | | 220 | 2.9 |
| | | 400 | 1.5 |
| | | 800 | 1 |
| 4. P—nonylphenol-EDA-PF | 2:1:2 | 220 | 2.6 |
| | | 400 | 1.9 |
| 5. p-dodecylphenol-EDA-PF | 4:1:4 | 520 | 0 |
| 6. MD* | — | 200 | 0 |

*MD — N,N'—disalicylidene-1,2-cyclohexanediamine

Oxygen tests (using 1.6M mols Cu) were undertaken. Results are reported in Table II.

TABLE II

| Deactivator | Molar Ratio A:B:C | Concentration Used, mMols | Δ P |
|---|---|---|---|
| Blank | — | — | 48, 49 |
| MD | | 2.5 | 7.5 |
| p-nonylphenol-EDA-PF | 2:1:2 | 0.8 | 17, 48* |
| | | 1.1 | 17 |
| | | 2.3 | 5 |
| p-nonylphenol-EDA-PF | 4:1:4 | 1.0 | 21 |
| | | 2.0 | 6 |

*Probable leak in autoclave

Additional oxygen tests were also undertaken with various Mannich products of the invention and comparative materials with varying metal species as indicated. Results appear in Table III as follows:

TABLE III

| Metal Species | Deactivator (Molar Ratio) | mgs of Deactivator | mL $O_2$ in 5 min. |
|---|---|---|---|
| Cu Naphthenate | Blank | — | 105, 105, 105 (in 15 sec.) |
| | PC-TETA-PF (2:1:2) | 100 | 0 |
| | PC-TETA-PF (2:1:2) | 100 | 0 |
| | PC-EDA-PF (2:1:2) | 100 | 0 |
| | PC-EDA-PF (2:1:2) | 100 | 14 |
| | 90% NP-EDA-PF (2:1:2) | 100 | 13, 10 |
| Fe Naphthenate (old source) | Blank | — | 31, 30, 30 |
| | PC-TETA-PF (2:1:2) | 100 | 0, 20 |
| | PC-TETA-PF (2:1:2) | 100 | 30 |
| | PC-EDA-PF (2:1:2) | 100 | 0 |
| | 90% NP-EDA-PF (2:1:2) | 100 | 0 |
| Fe Naphthenate (new source) | Blank | — | 68, 65, 68 |
| | PC-TETA-PF (2:1:2) | 100 | 100 |
| | PC-TETA-PF (2:1:2) | 100 | 84, 91 |
| | PC-TETA-PF (2:1:2) | 200 | 82 |
| | PC-EDA-PF (2:1:2) | 100 | 87 |
| | PC-EDA-PF (2:1:2) | 100 | 82, 84 |
| | PC-EDA-PF (2:1:2) | 200 | 22 |
| | 90% NP-EDA-PF (2:1:2) | 100 | 32, 32 |

TABLE III-continued

| Metal Species | Deactivator (Molar Ratio) | mgs of Deactivator | mL $O_2$ in 5 min. |
|---|---|---|---|
| | 90% NP-EDA-PF (2:1:2) | 200 | 3, 4 |
| (Prod. batch) | NP-EDA-PF (2:1:2) | 100 | 29 |
| | MD | 100 | 81, 86 |
| $FeCl_3$ (in water) | Blank | — | 65 |
| | 90% NP-EDA-PF (2:1:2) | 100 | 5 |
| | MD | 100 | 44 |
| $FeCl_3$ in water (next day) | Blank | — | 25, 20 |
| | 90% NP-EDA-PF (2:1:2) | 100 | 11 |
| | MD | 100 | 0 |
| Fe II Acetate in water | Blank | — | 0 |
| | Blank | — | 30 using 20 mL $H_2O_2$ |
| | 90% NP-EDA-PF (2:1:2) | 100 | 26 |
| | MD | 100 | 100 |
| Fe in halogenated hydrocarbon | Blank | — | 105, 105 (in 15 sec.) |
| (Prod. batch) | NP-EDA-PF (2:1:2) | 100 | 105 (60 sec.) |
| (Prod. batch) | NP-EDA-PF (2:1:2) | 200 | 21 |
| (Prod. batch) | NP-EDA-PF (2:1:2) | 400 | 20 |
| | PC-EDA-PF (2:1:2) | 200 | 12 |
| | MD | 100 | 105 (40 sec.) |
| | MD | 200 | 105 (40 sec.) |
| Co Naphthenate | Blank | — | 47 |
| | 90% NP-EDA-PF (2:1:2) | 100 | 0 |
| | MD | 100 | 21 |
| Ni Octanoate | Blank | — | 22 |
| | 90% NP-EDA-PF (2:1:2) | 100 | 4 |
| | MD | 100 | 9 |
| V Naphthenate | Blank | 0 | 21 |
| | 90% NP-EDA-PF (2:1:2) | 100 | 0 |
| | MD | 100 | 0 |
| Cr Naphthenate | Blank | 0 | 5 |
| | 90% NP-EDA-PF (2:1:2) | 100 | 0 |
| | MD | 100 | 0 |

PC = para-cresol
TETA = triethylenetetramine
PF = paraformaldehyde
EDA = ethylenediamine
NP = nonylphenol
MD = N,N'—disalicylidene-1,2-diaminocyclohexane Table III indicates that the para-cresol TETA PF compounds deactivated copper but not iron. In contrast, the P-cresol EDA-PF compounds deactivated both copper and iron. The MD activates iron naphthenate and acetate and appears to slightly deactivate some other forms of iron. The MD appears to slightly deactivate Co and Ni as well as V and Cr. Overall, the NP-EDA-PF Mannich product is more efficacious than MD.

EXAMPLE A

The reactivity of copper and iron were determined by the peroxide, oxygen absorption test, and ASTM test described above. Results are shown in Table IV.

TABLE IV

| Test | Units | Reactivity (Averages) for Metal Naphthenates With No Metal Chelators Added: No Metal | Copper | Manganese | Iron |
|---|---|---|---|---|---|
| Peroxide | mL of $O_2$/min | 0/10 min | 105/0.5 min | 105/2 min | 15/5 min |
| Oxygen Abs | psig/hr | 0 | 48 | — | 5 |
| ASTM | min | 55 | 22 | — | 49 |

Each of these tests show the same results, namely, copper is the more active catalyst and iron is much less active, although iron is still an active catalyst for promoting oxidation reactions. Manganese is between copper and iron in reactivity as evidenced in the peroxide test.

EXAMPLE B

The Table IV tests above were repeated, but this time with N,N'-disalicylidene-1,2-diaminocyclohexane (DM) present (Table V).

TABLE V

Reactivity (Averages) by Test Method for Metal Naphthenates With N,N—disalicylidene-1,2-diaminocyclohexane (DM)

| Test | Units | Amt of Chelator | No Metal | Copper | Manganese | Iron |
|---|---|---|---|---|---|---|
| Peroxide | mL $O_2$/min | 100 mg | 0 | 15/5.0 | 105/0.3 | 90/5 |
| Oxygen Abs | psig/hr | 0.5 g | 0 | 14.5 | — | — |
| ASTM | min | 123 ppm | 56 | 52 | — | 27 |

Comparing Example A and Example B shows that catalytic activity of the copper was reduced (deactivated) by the N,N-disalicylidene-1,2-diaminocyclohexane, but that of iron and manganese were increased (activated).

EXAMPLE 1

A series of products were prepared by reacting p-nonylphenol, ethylenediamine, and paraformaldehyde in xylene. For the 2-1-2 product, 110 g (0.5 mol) of nonylphenol, 15 g (0.25 mol) of ethylenediamine, 16.5 g (0.5 mol) of paraformaldehyde, and 142 g of xylene were charged to a 3-necked flask fitted with a condenser, a thermometer, and a stirrer. The mixture was slowly heated to 110° C. and held there for two hours. It was then cooled to 95° C. and a Dean Stark trap inserted between the condenser and the flask. The mixture was heated to 145° C., during which time water of formation was azeotroped off—9 mL was collected—approximately the theoretical amount. The mixture was cooled to room temperature and used as is.

EXAMPLE 2

The 4-1-4, 1-1-2, and 2-1-2 products from Example 1 were evaluated in the peroxide test (Table VI) and in the Oxygen Absorption test (Table VII).

TABLE VI

Peroxide Test Data for p-Nonylphenol-EDA-Formaldehyde mL of Oxygen Evolved in 5.0 Min.

| | Copper | | | Iron | | |
|---|---|---|---|---|---|---|
| Mgs Chelator | 4-1-4 | 1-1-2 | 2-1-2 | 4-1-4 | 1-1-2 | 2-1-2 |
| 500 | 10 | 7 | 7* | 7 | 11, 0 | 0* |
| 100 | 50 | 13** | 3 | 5 | 10** | 6 |

*600 mgs
**125 mgs

TABLE VII

Oxygen Absorption Data for p-Nonylphenol-EDA-Formaldehyde Change in Pressure Over 60 Minutes With Copper

| | Pressure Change | |
|---|---|---|
| Grams Chelator | 2-1-2 | 4-1-4 |
| 2.0 | 17 | 21 |
| 4.0 | 3.5, 4.5 | 6 |

In this example, it can be seen that at very high levels of any ratio all products work. But as treatment is decreased to more cost effective levels, the 2-1-2 product is more effective for copper and all ratios are effective for iron.

These products are effective iron deactivators in contrast to N,N-disalicylidene-1,2-diaminocyclohexane, an iron activator.

EXAMPLE 3

A series of products prepared by reaction of p-dodecylphenol, EDA, and formaldehyde as in Example 1 were tested in the peroxide test (Table VIII).

TABLE VIII

Peroxide Test Data for p-Dodecylphenol-EDA-Formaldehyde mL of Oxygen Evolved in 5.0 Min.

| | Copper | | | Iron | | |
|---|---|---|---|---|---|---|
| Mgs Chelator | 4-1-4 | 1-1-2 | 2-1-2 | 4-1-4 | 1-1-2 | 2-1-2 |
| 500 | 8 | 5 | 5* | 7 | 6 | 7* |
| 100 | 100 | 80 | 21 | 3 | 10 | 7 |

*450 mgs

As above, at high treatment levels all products show efficacy. However, at lower treatment levels, the 2-1-2 molar ratio product is superior for copper and all are similar for iron.

The next two examples further illustrate the efficacy of the invention.

EXAMPLE 4

The 1-1-2 and 2-1-2 products from the reaction of p-t-octylphenol, EDA, and formaldehyde were prepared as in Example 1 and tested in the peroxide test (Table IX).

TABLE IX

Peroxide Test Data for p-t-Octylphenol-EDA-Formaldehyde mL of Oxygen Evolved in 5.0 Min.

| | Copper | | Iron | |
|---|---|---|---|---|
| Mgs Chelator | 1-1-2 | 2-1-2 | 1-1-2 | 2-1-2 |
| 500 | 7 | 0 | 9 | 20, 0 |
| 125 | — | 7, 0 | — | 7 |
| 100 | 13 | — | 7 | — |
| 63 | — | 105 | — | 10 |

EXAMPLE 5

The p-t-butylphenol-EDA-formaldehyde products were prepared as in Example 1 and tested in the peroxide test (Table X).

TABLE X

Peroxide Test Data for p-t-Butylphenol-EDA-Formaldehyde mL of Oxygen Evolved in 5.0 Min.

| Mgs Chelator | Copper 2-1-2 | Iron 2-1-2 |
|---|---|---|
| 320 | 5 | 5 |
| 100 | 3 | 5 |

EXAMPLE 6

Deactivation of manganese is achieved by the compounds of the invention. Again, the 1-1-2 compounds also deactivate manganese but not as well as the 2-1-2 compounds (Table XI).

TABLE XI

| Peroxide Test on Manganese Naphthenate mL of Oxygen Evolved in 5.0 Min. | | |
|---|---|---|
| Phenol | mgs | mL |
| None | — | 104/2 min. |
| *t-Butyl 2-1-2 | 1000 | 14 |
| *t-Butyl 2-1-2 | 500 | 47 |
| *Nonyl 1-1-2 | 1000 | 41 |

*Compounds formed from phenol-EDA- and PF.

EXAMPLE 7

The p-alkylphenol-TETA-formaldehyde products were prepared as in Example 1 and tested in the peroxide test (Table XII).

TABLE XII

| Peroxide Test Data for p-alkylphenol-TETA-Formaldehyde mL of Oxygen Evolved in 5.0 Min. | | | | |
|---|---|---|---|---|
| Alkyl | Ratio | Mgs Chelator | Copper | Iron |
| Nonyl | 2-1-2 | 440 | 5 | 16 |
| Nonyl | 2-1-2 | 88 | 14 | 23 |
| Dodecyl | 2-1-2 | 500 | 3 | 27 |
| Dodecyl | 2-1-2 | 100 | 25 | 32 |
| Dodecyl | 1-1-2 | 500 | 0 | 74 |
| Dodecyl | 1-1-2 | 100 | 7 | 73 |

This example shows that TETA in place of EDA provides a good copper deactivator, but an iron activator.

EXAMPLE 8

Mixtures of polyamines can be used in the preparation of the Mannich products, prepared as in Example 1 and tested in the peroxide test (Table XIII).

TABLE XIII

| Peroxide Test Data for p-Alkylphenol-EDA-TETA-Formaldehyde mL of Oxygen Evolved in 5.0 Min. | | | | |
|---|---|---|---|---|
| Alkyl | Ratio | Mgs Chelator | Copper | Iron |
| Nonyl | 1-.5-.5-2 | 500 | 9 | 39 |
| Nonyl | 1-.5-.5-2 | 100 | 7 | 46 |
| Dodecyl | 1-.5-.5-2 | 500 | 11 | 33 |
| Dodecyl | 1-.5-.5-2 | 100 | 50 | 11 |

This example shows that mixtures of polyamines give good copper deactivators and iron activators.

EXAMPLE 9

The dialkylphenol-polyamine-formaldehyde products were prepared as in Example 1 and tested in the peroxide test (Table XIV).

TABLE XIV

| Peroxide Test Data for 2-1-2 Ratio 2,4-Dialkylphenol-Polyamine-Formaldehyde mL of Oxygen Evolved in 5.0 Min. | | | | |
|---|---|---|---|---|
| Alkyl | Polyamine | Mgs Chelator | Copper | Iron |
| t-Butyl | EDA | 500 | 105 | 18 |
| t-Amyl | EDA | 500 | 96 | 0 |
| t-Butyl | DETA | 500 | 0 | 50 |
| t-Butyl | TETA | 500 | 17 | 100* |
| t-Amyl | TETA | 500 | 0 | 87 |

*mL of oxygen was evolved in 30 seconds
DETA = diethylenetriamine

This example shows that copper deactivation occurs with all of the products, although better deactivation occurs with DETA and TETA. Iron is activated by the DETA and TETA materials and deactivated or not effected by EDA materials.

Reasonable variations and modifications which will be apparent to those skilled in the art can be made without departing from the spirit and scope of the invention.

We claim:

1. A method of inhibiting the formation of free radicals in a hydrocarbon medium by deactivating a metallic species selected from the group consisting of Cu, Fe, Co, Ni, V, Cr, and Mn contained in said hydrocarbon medium, wherein in the absence of said deactivating said metallic species would initiate formation of free radicals in said hydrocarbon medium in turn leading to decomposition of said hydrocarbon medium, said method comprising inhibiting said formation of free radicals by adding to said hydrocarbon medium, which already contains said metal species, an effective amount to deactivate said metallic species of an effective Mannich reaction product formed by reaction of reactants (A), (B), and (C), wherein (A) comprises an alkyl substituted phenol of the structure

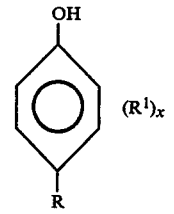

FORMULA I wherein R and $R^1$ are the same or different and are independently selected from alkyl, aryl, alkaryl, or arylalkyl of from about 1 to 20 carbon atoms and x is 0 or 1; (B) comprises a polyamine of the structure $$H_2N(\underset{\underset{R_2}{|}}{CH}-(CH_2)_y-\underset{\underset{R_3}{|}}{CH}-NH)_Z-H$$

FORMULA (II)

wherein Z is a positive integer, $R_2$ and $R_3$ are the same or different and are independently selected from H, alkyl, aryl, aralkyl, or alkaryl having from 1 to 20 carbon atoms, y being 0 or 1; and (C) comprising an aldehyde of the structure $$R_4-\overset{\overset{O}{\|}}{C}-H$$

FORMULA (III)

wherein $R_4$ comprises H or $C_1$–$C_6$ alkyl.

2. A method as recited in claim 1 wherein said metallic species comprises copper.

3. A method as recited in claim 1, the molar ratio of reactants (A):(B):(C) being 0.5-5:1:0.5-5.

4. A method as recited in claim 3 wherein said Mannich reaction product is added to said hydrocarbon medium in an amount of from 0.5–50,000 ppm based upon one million parts of said hydrocarbon medium.

5. A method as recited in claim 4 wherein said Mannich reaction product is added to said hydrocarbon medium in an amount of 1 to 10,000 ppm based upon one million parts of said hydrocarbon medium.

6. A method as recited in claim 5 wherein said hydrocarbon medium is heated at a temperature of from 100°–1000° F.

7. A method as recited in claim 6 wherein said hydrocarbon medium is heated at a temperature of about 600°-1000° F.

8. A method as recited in claim 6 wherein (A) comprises a member or members selected from the group consisting of p-cresol, 4-ethylphenol, 4-t-butylphenol, 4-t-amylphenol, 4-t-octylphenol, 4-dodecylphenol, 2,4-di-t-butylphenol, 2,4-di-t-amylphenol, and 4-nonylphenol.

9. A method as recited in claim 6 wherein said polyamine (B) is selected from the group consisting of ethylenediamine and triethylenetetramine.

10. A method as recited in claim 6 wherein said aldehyde (C) is selected from the group consisting of formaldeyde and paraformaldehyde.

11. A method as recited in claim 1 wherein said metallic species comprise copper and iron.

12. A method of simultaneously deactivating copper and iron species contained within a hydrocarbon liquid wherein in the absence of said deactivating method said copper and iron species would initiate the decomposition of the hydrocarbon liquid, said method comprising adding to said hydrocarbon liquid an effective amount to inhibit said copper and iron species from forming said free radicals of an effective Mannich reaction product formed by reaction of reactants (A), (B), and (C) wherein (A) comprises an alkyl substituted phenol of the structure

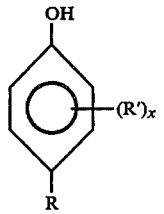

FORMULA I wherein R and $R^1$ are the same or different and are independently selected from the alkyl, aryl, alkaryl, or arylalkyl of from about 1 to 20 carbon atoms and x is 0 or 1; (B) is ethylenediamine, and (C) comprises an aldehyde of the structure

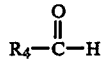

FORMULA (III)

wherein $R_4$ comprises H or $C_1$-$C_6$ alkyl.

13. A method as recited in claim 12 wherein said Mannich reaction product is added to said hydrocarbon liquid in an amount of from 0.5 to 50,000 ppm based upon one million part of said hydrocarbon medium.

14. A method as recited in claim 13 wherein said Mannich reaction product is added to said hydrocarbon liquid in an amount of from about 1 to 10,000 ppm based upon one million parts of said hydrocarbon medium.

15. A method as recited in claim 14 wherein said hydrocarbon liquid is heated at a temperature of about 100°-1000° F.

16. A method as recited in claim 15 wherein said hydrocarbon liquid is heated at a temperature of about 600°-1000° F.

17. A method as recited in claim 15 wherein (A) comprises a member selected from the group consisting of p-cresol, 4-ethylphenol, 4-t-butylphenol, 4-t-amylphenol, 4-t-octylphenol, 4-dodecylphenol, 2,4-di-t-butylphenol, 2,4-di-t-amylphenol, and 4-nonylphenol.

18. A method as recited in claim 17 wherein (A) comprises nonylphenol.

19. A method as recited in claim 12 wherein the molar ratio of reactants (A):(B):(C) falls within the range of 1-2:1:1-2.

20. A method as recited in claim 13 wherein (A) comprises nonylphenol, (C) comprises paraformaldehyde or formaldehyde and the molar ratio of reactants (A):(B):(C) is about 2:1:2.

* * * * *